United States Patent [19]

Burriss et al.

[11] Patent Number: 4,621,382

[45] Date of Patent: Nov. 11, 1986

[54] RESCUE SUPPORT MEMBER

[76] Inventors: Richard R. Burriss, 7 Adelaide St.; Henry C. H. Alsop, 18 Naples St., both of Mornington, Victoria, Australia, 3931

[21] Appl. No.: 649,821

[22] Filed: Sep. 12, 1984

[30] Foreign Application Priority Data

Jul. 18, 1984 [AU] Australia ..... PG6070

[51] Int. Cl.[4] ..... A61G 1/00; B63C 9/04

[52] U.S. Cl. ..... 5/82 R; 5/424; 441/129

[58] Field of Search ..... 5/82 R, 82 B, 425, 424, 5/449, 431, 417, 420; 441/40, 129, 128

[56] References Cited

U.S. PATENT DOCUMENTS

| | | | |
|---|---|---|---|
| 2,347,389 | 4/1944 | Baker et al. | 5/82 |
| 2,614,266 | 10/1952 | Smith | 5/82 B |
| 2,629,884 | 3/1953 | McMonagle | 5/455 |
| 2,644,173 | 7/1953 | James | 5/425 |
| 3,264,659 | 8/1966 | Magni et al. | 5/82 R |
| 3,601,824 | 8/1971 | Bradford | 5/82 R |
| 3,740,778 | 6/1973 | Jordan et al. | 5/82 R |
| 4,254,518 | 3/1981 | Buhren et al. | 5/424 |
| 4,466,145 | 8/1984 | Jones et al. | 5/82 R |

FOREIGN PATENT DOCUMENTS

| | | | |
|---|---|---|---|
| 2928629 | 1/1981 | Fed. Rep. of Germany | 5/82 R |
| 148718 | 6/1981 | German Democratic Rep. | 5/82 R |
| 565036 | 10/1944 | United Kingdom | 5/82 R |

OTHER PUBLICATIONS

Town Crier Newspaper, Thursday, Sep. 15, 1983, p. 7, Victoria, Australia.

*Primary Examiner*—Alexander Grosz
*Attorney, Agent, or Firm*—Parmelee, Bollinger & Bramblett

[57] ABSTRACT

The invention relates to an improved inflatable and buoyant rescue-support member for use and co-operation with a JORDAN stretcher (lifting) frame, for carrying or transporting a patient from a water environment.

13 Claims, 3 Drawing Figures

RESCUE SUPPORT MEMBER

Figure 1:
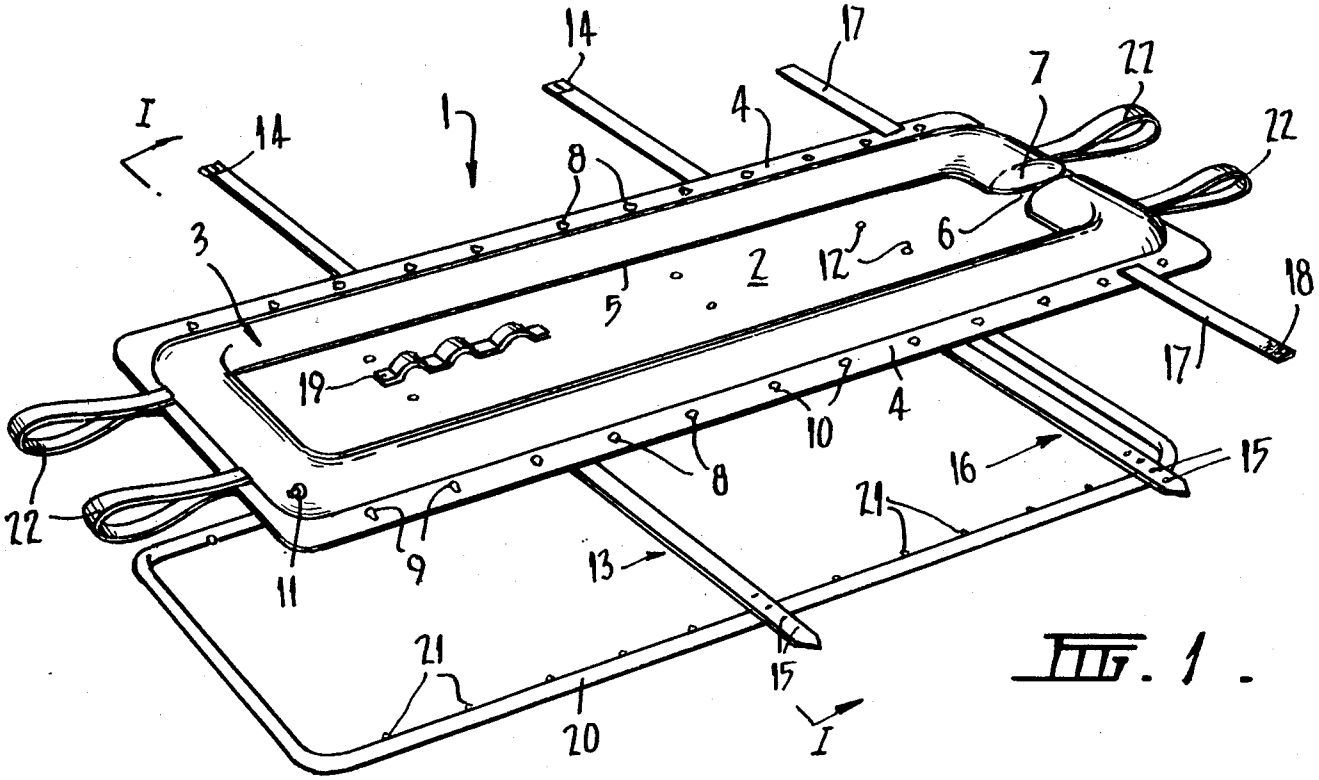

The invention relates to an improved rescue support member adapted for use and co-operation with a stretcher frame, for carrying or transporting of a patient from a water environment. The invention is particularly applicable to a rescue support member for use with a JORDAN stretcher (lifting) frame in sea rescue.

As is appreciated, when a person is injured or disabled as a result of an accident and has suffered from spinal or internal injuries, it is necessary in an effort to prevent further or aggrevate those injuries, to nullify the patient's movements. To this end, the rescuers endeavour to immobilise the patient by constraining their voluntary movement and to ensure minimal possible mishandling or body movement.

When transporting the patient from the crisis situation to an emergency vehicle, it is also often necessary to transfer the patient from the initial rescue stretcher to one specifically adapted for use in the emergency vehicle. Unfortunately, when transferring the patient from one stretcher to another stretcher, the patient is inevitably moved, which movement may exacerbate the patient's injuries.

The above problems in restricting patient movement is heightened even more, due to the inherent difficulties associated with rescuing a patient from the sea, where the patient must be secured to a floatable stretcher and removed from the sea to the rescue craft, while the stretcher, rescue craft and rescuers are buffeted by wave action. Unless, the patient is held securely upon the floatable stretcher, their journey in the rescue craft, as a result of the often bone-jarring movement of the rescue craft as it crashes through the water, therefore increases the risk of further or aggrevated injury of the patient's initial condition. As the floatable stretcher is unlikely to be compatible with the stretcher as used in an emergency land vehicle, the injured patient must therefore be transferred from the floatable stretcher to that as carried by the emergency land vehicle and as a result of that transference, the injured patient again increases the risk of further or aggrevated injury.

Hitherto before, floatable rescue stretchers have been in the form of a wooden-flat plank or surfboard which in use, have been found to be heavy, cumbersome and requiring at least four to five persons to effectively handle, maneuvre and secure the patient thereto. A further disadvantage of such rigid floatable stretchers due to their size, is that they occupy a valuable amount of limited space available on board the rescue craft. At least four to five persons are required to manipulate the wooden plank, in that, at least three of the rescuers while floating in the water are required to hold the patient upon the board, while a further one or two rescuers endeavour to propel the plank with the patient hand-held thereto towards the awaiting rescue craft. The further rescuer who is on board the rescue craft, is necessary to assist the other rescuers floating in the water, to lift the injured patient and plank out of the water and into the craft. Accordingly, when using the wooden plank stretcher at least four to five rescuers are necessary to retrieve one patient from the water into the rescue craft. While the rescue craft is in transit from the crisis situation to an awaiting emergency land vehicle, three rescuers have been necessary to firmly hold the patient upon the plank to prevent the patient from rolling about in the rescue craft, as a result of the wave action upon the craft. Once the rescue craft reaches land, it has been necessary to transport that patient from the wooden plank to a conventional stretcher as the plank has not been adapted for use in the emergency land vehicle.

Accordingly, as can be seen, conventional wooden planks or surfboard stretchers have most serious drawbacks in that one cannot satisfactorily immobilise the patient during their retrieval from the water to the rescue craft, and, during their transport from the crisis situation to the awaiting emergency land vehicle. Additionally, due to the limited space available on board the rescue craft, and the need for at least three rescuers to secure one injured patient, further problems are associated where there are more than one injured person.

It is an object of the present invention, to provide an improved rescue support member which alleviates or at least minimizes the problems associated with the prior art rescue stretchers.

A further object of the invention is to provide a rescue support member, which is easier to use, requires less space on board a rescue craft, requires less rescuers in retrieving an injured person from the water, and, that can be used with existing stretchers in conventional emergency land vehicles, thereby obviating the need to transfer the injured patient from one stretcher to another.

It is another object of the present invention that the rescue support member can be used with the JORDAN stretcher frame as described in Australian Patent Specification No. 458157, which stretcher frame is now used in emergency land vehicles worldwide to lift and carry people with spinal and/or internal injuries.

The rescue support member of the present invention is adapted for use and co-operation with a stretcher frame, for carrying or transporting of a patient from a water environment. The support member comprises a central portion; an inflatable portion; and a peripheral edge portion. The peripheral edge portion provides means for securing the support member to the stretcher frame. The inflatable portion is positioned between the central portion and the peripheral edge portion to surround at least a majority of the central portion, and upon inflation of the inflatable portion, impart buoyancy to the support member. The central portion is adapted to receive and retain the patient when the patient is located on the support member.

The support member may be of any suitable peripheral shape, for example, oval, rectangular, square etc. However the support member is preferably of a complimentary shape to its co-operating stretcher frame and as most conventional stretcher frames are substantially rectangular, a substantially rectangular support member will hereinafter be described.

The support member may be formed from any suitable conventional material, which is air and water impervious, by any conventional means. However, plastics materials have been found to readily lend themselves to the present application. For example, a polyvinyl chloride of suitable thickness and strength can be used. In one form, the support member can be considered to have opposed front and rear surfaces. Preferably, wherein the front and rear surfaces are of the same rectangular configuration and are joined together by way of at least an edge extending around the support member's periphery. A support member of plastics material may be formed by the conventional techniques of block welding, adhesives, sewing, etc. In the block welding operation, the weld line between the two opposed surfaces may form the edge extending around the body member's periphery.

The support member comprises a central portion the majority of which is surrounded by the inflatable portion.

The central portion is preferably joined to the inflatable portion through a junction, which junction is preferably in the form of a weld line(s) which can separate the central portion from the inflatable portion. In this form, upon inflation of the inflatable portion (i.e. rendering the inflatable portion operational), the central portion does not inflate or is not inflated to the same extent as the inflatable portion. In this way, the central portion and the inflatable portion (when operational) may form a cradle, such that the patient when received upon the central portion is cradled therebetween, and, thus also provides a convenient support against sideway movement of the patient's body within the support member.

Wherein, the inflatable portion is substantially U-shaped it preferably extends continuously along both longitudinal sides and at least across one lateral side of the support member. In this form, the central portion is not totally surrounded by or within the inflatable portion and is therefore provided with a passageway to the adjacent peripheral edge at the other opposite lateral side of the support member. Preferably, the passageway is adapted to receive and locate the head and/or neck of the patient therein. In this form, the passageway can act as a pillow or buffering zone to prevent sideways movement of the patient's head which in turn therefore reduces the patient's head and/or neck movement, and the risks of further or aggravated injury to those regions.

The central portion in a preferred construction is a web having an open-weave configuration which is secured to the inflatable portion via the junction weld. In this way, water which splashes over the inflatable portion and into the central portion of the support member, will not be retained in and otherwise effect the buoyancy of the support member. In another form, the central portion is of a solid-web configuration and can be of the same material as the inflatable portion. In this form, the central portion is preferably provided with drainage holes, such that water which splashes into the central portion can dissipate therethrough, so as to once again not effect the buoyancy of the support member.

The inflatable portion of the support member is preferably substantially large enough that when inflated, it will not only support the weight of the injured patient located thereon, but will also provide sufficient buoyancy to the support member wherein a JORDAN stretcher frame is attached thereto.

Preferably the support member is secured to the stretcher frame by means of eyelets situated in the peripheral edge portion of the support member. These eyelets being engagable over corresponding receiving means suitably positioned around the stretcher frame. The receiving means are preferably shaped to allow engagement of the eyelets thereover when the inflatable portion is not inflated and are of the type which prevents disengagement of the eyelets therefrom when the inflatable portion is inflated. Accordingly the receiving means and the eyelets secure the support member to the stretcher frame to form a substantially buoyant rescue stretcher when the inflatable portion is operational.

In one form, the eyelets have a substantially key-hole shaped configuration which configuration comprises a substantially circular opening communicating with a substantially rectangular slot. In this form, it is preferred that the receiving means of the stretcher frame are headed pins which have an enlarged head atop a reduced diameter portion. Accordingly, in this form, when the inflatable portion is not inflated, the enlarged pin head is adapted to engage with the circular opening of the eyelet. Upon inflation of the inflatable portion, the reduced diameter portion of the pin will slidably engage into and therefore co-act with the rectangular slot, and, thereby prevents disengagement of the support member from the stretcher frame, by reason of the enlarged pin head being unable to pass through the smaller rectangular slot opening.

The eyelets are preferably constructed of an appropriate material, such as a non-corrosive plastics material of appropriate strength and thickness. In this form, the eyelets can be block welded to the peripheral edge portion during manufacture of the support member.

The inflatable portion is preferably provided with at least one air inlet port through which air can be introduced into the interior of the inflatable portion, to inflate the inflatable portion to its operational condition. In another form, the inflatable portion may be provided with both an air inlet port and an air outlet port, or, the air inlet port may also function as the air outlet port under desired conditions. In this form, the inlet and/or outlet can be situated in any suitable position on the inflatable portion but it/they is/are preferably located at an easy access point on the inflatable portion, particularly when the support member is secured to the JORDAN frame to enable either inflation or deflation of the inflatable portion.

The support member is also preferably provided with releasable means for restraining the patient, from excessive sideward, forward or rearward movement during transport of the support member, when the patient is positioned upon the central portion. Preferably, the releasable means are a plurality of straps attached to the support member and which are adapted to hold the patient's head, chest and/or leg(s) into contact with the central portion so as to minimize movement of the patient's limbs during transport.

Preferably, the chest and leg straps are secured to underside of the central portion. The free ends of both of these straps being adapted to loop over and above the inflatable portion and to co-operate with their other respective free ends, so that the patient positioned upon the central portion can be secured thereto. Each of the free ends is preferably provided with an adjustable coupling means. For example, one of the free ends of the chest strap can be provided with a belt buckle while the other free end has a complimentary coupling means, for example holes. The leg strap may be of a similar or different arrangement. Another example of the adjustable coupling means is the material known by the registered trade mark VELCRO, which is located at each of the free ends of the strap. This material allows for easy engagement and release of the strap while also providing firm securement.

To ensure that the leg strap will secure a leg or both legs of the patient to the central portion, there is preferably provided on the central portion a strap tensioning means, which means is preferably in the form of a strap loop or loops. Accordingly, one of the free ends of the leg strap can be passed over one of the patient's legs, through the tensioning loop, over the other leg of the patient, and, then engage its appropriate coupling means on the other free end of the leg strap. In this way, it is possible to hold one or both of the legs of the injured patient firmly against the central portion.

The third releasable means is preferably adapted to minimize movement of the patient's head and/or neck region. In this form, it is preferably adapted to pass over the forehead of the patient and upon tensioning limits the sideward movement of the injured patient's head and/or neck. Preferably, this releasable means may also be in the form of a strap or two co-acting straps, one end of both of which is securable directly to the support member while their free ends are adapted to engage and co-act with one another, to hold the injured patient's head and/or neck in contact with the central portion. In one form, the fixed ends of both of the head straps are securable to the peripheral portion while their free ends are adapted to overlap the forehead of the injured patient. Preferably the free ends of each of the head straps are provided with the material as known by the registered trade mark VELCRO.

To each of the lateral edge surfaces of the support member is preferably located carrier means. The carrier means are preferably in the shape of loops which are adapted to assist in the carrying or transport of the support member per se. The carrier means can also assist in lifting or raising the support member and co-acting JORDAN frame from the water, rescue craft, or the emergency land vehicle.

The releasable means and carrier means may be formed from any suitable material as is known in the art and can be of an appropriate suitable strength, thickness size and/or combination thereof.

Figure 2:
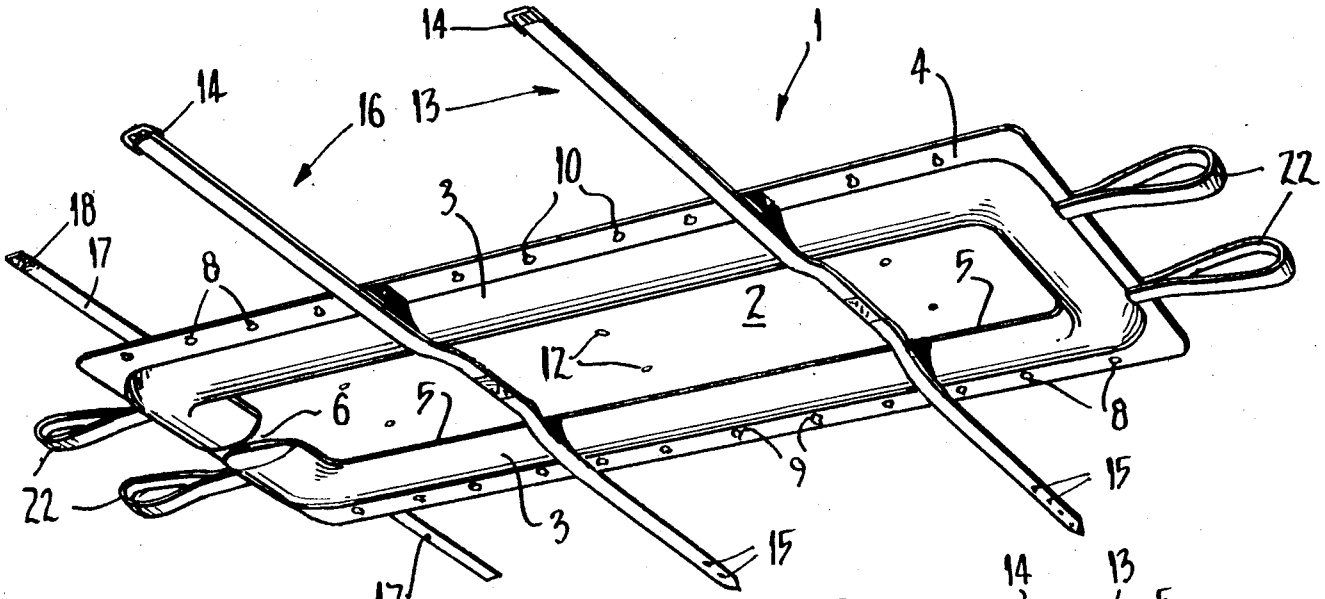
Figure 3:
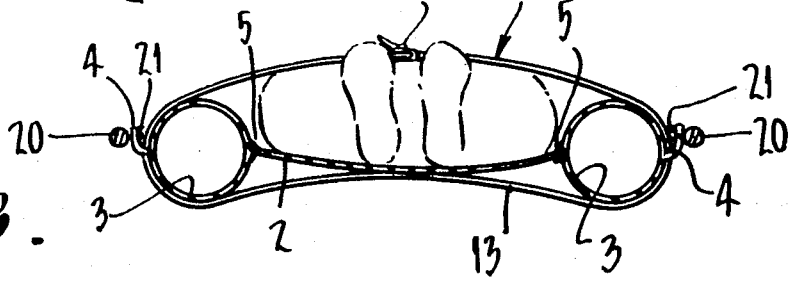

An example embodiment of the present invention is illustrated in the accompanying drawings, in which:

FIG. 1 is an exploded view of the support member in association with a JORDAN stretcher frame, FIG. 2 is a perspective view of the underside of the support member as shown in FIG. 1, and FIG. 3 is a cross sectional view taken through line I—I of FIG. 1 wherein the support member and JORDAN stretcher frame are in an in-use situation with a patient secured thereon.

As shown in the drawings, the support member (1) has a substantially rectangular peripheral configuration. The support member can be produced using any of the conventional techniques employed when combining plastics material. However, it is preferred to use two sheets of suitable plastics material which are block welded together to form the central portion (2), and inflatable portion (3), and peripheral edge portion (4) of the support member. The junction (5) preferably a weld line, separating the central portion (2) from the inflatable portion (3), may also be formed during the block welding operation.

The inflatable portion (3) as illustrated is in its inflated operational condition, and would normally, when in its deflated condition, lie in the same plane as the flat central portion (2).

The peripheral edge portion (4) and junction (5) usually provide the configuration to be assumed by the inflatable portion. In the present drawings, the inflatable portion substantially surrounds the central portion (2) except at the passageway (6). The passageway (6) in conjunction with terminate rounded ends (7) of the inflatable portion (3) are adapted to receive the patient's head and/or neck, and substantially minimize unwanted sideways movement of the patient's head and/or neck. The passageway (6) and rounded ends (7) therefore provide a pillow for the patient, but more importantly, assist in preventing further or aggravated injury in the head/neck region.

The longitudinal peripheral edge (4) of the support member are provided with key-hole shaped eyelets (8), having an enlarged circular region (9) and a rectangular slot (10) communicating therewith. These eyelets (8) are adapted for securing the support member to a JORDAN stretcher frame (20). Receiving means in the shape of headed pins (21) on the JORDAN frame are adapted to co-operate with the eyelets (8) on the support member.

The pins (21) are usually formed of a projecting end from the frame in the shape of an enlarged head and a portion of reduced diameter immediately adjacent to the head. While the support member is deflated, a pin head is adapted to pass through the circular region (9) of the eyelet (8), but upon inflation of the inflatable portion (3), the overall width of the support member is slightly reduced, and thereby causes the reduced diameter porton of the pin (21) to slidably engage into the rectangular slot (10). Accordingly, due to the increased size of thehead of the pin (21), it is prevented from sliding through the smaller rectangular slot (10) and therefore the support member is secured to the stretcher frame.

A combined air inlet/outlet port (11) is positioned on the inflatable portion (3) to enable inflation or deflation of the inflatable portion.

Drainage holes (12) are suitably positioned in the central portion (2), to enable water which splashes into the support member to dissipate therethrough so as to not effect the buoyancy of the support member.

Releasable means in the form of straps (13), (16) and (17) are positioned on the support member to hold the patient upon the central portion (2) while in transit. Two straps (13) and (16) are fixed to the support member on the underside of the central portion (2) as best shown in FIG. 2. The third, a two-part strap (17), is securable to the peripheral edge portion (4) to the support member. All three straps are provided with adjustable coupling means which can be in the form of a belt buckle (14) and corresponding co-acting holes (15) for leg strap (13) and chest strap (16). The adjustable coupling means may also be made of VELCRO hook and loop type fastener as shown at (18) for head strap (17). Each of the three straps are capable of overlapping and being suitably fastened when a patient's body is positioned on the central portion (FIG. 3 refers).

Strap tensioning means, loops (19), are located on the central portion (2) which enable firm securement of the patient's leg or legs to the central portion. In use, that part of the leg strap (13) with the holes (15) is passed over one of the patient's legs, through the appropriate loop (19), over the other leg of the patient and then co-operates with the buckle end (14) of its strap. Upon applying appropriate tension to the strap (13), the legs of the patient can be firmly held against the central portion. The straps (13), (16) and (17) not only assist in holding the patient to the central portion, but can cause the inflatable portion (3) to contact the patient's body so as to cradle and more securely hold the patient's body within the support member.

Carrier means in the form of loops (22) can be used to carry the floatable support by itself or when so attached to the JORDAN stretcher frame.

As will be readily appreciated, the support member of the present invention offers substantial advantages over the difficulties encountered with the earlier rescue stretchers, in that only two rescuers if necessary are required to be in the water, to secure the injured patient to the support member, and in favourable conditions, only one rescuer need be in the water with the patient. Once secured to the support member, the patient and support member can be easily lifted from the water into the rescue craft, by two, most preferably three rescuers, since the patient is firmly held upon the support member, and does not require additional hands-on securement by the rescuers. While the rescue craft is in transit, the possibility of the patient rolling off the support member is unlikely and the patient is further buffeted from the bone jarring shocks caused by the rescue craft crashing through the waves, as a result of the cushioning effect provided by the central and inflatable portions.

As the JORDAN stretcher frame is now in use in emergency land vehicles around the world, the adaptation of the support member for use with the JORDAN frame, overcomes the need of moving the patient from one type of stretcher to the JORDAN stretcher frame. Accordingly, the possibility of further aggravating the patient's condition during transfer from one stretcher to another is overcome.

Since the JORDAN stretcher frame is itself able to be dismantled, and as the present support member is adapted to be stowed in a rolled up configuration, the resultant stretcher therefore does not occupy valuable space on board the rescue craft. In view of the lightweight nature of support member, it has been found to be easier to handle, maneuvre and secure. For example, it is now possible that once buoyant, the support member can be easily slid under the injured patient while he is floating in the water and as a result, support the injured patient in a supine position. With the patient and support member substantially riding on top of the water, there is less drag in towing or pushing the patient and support member towards the rescue craft.

Finally, it is to be understood that there are alterations, modifications and/or additions that may be introduced into the constructions and arrangements of parts previously described, without departing from the spirit or ambit of the invention.

We claim:

1. A rescue support member adapted for use and co-operation with a stretcher frame, for carrying or transporting a patient from a water environment, said support member comprising a central portion; an inflatable portion; and a peripheral edge portion; said peripheral edge portion having eyelets adapted to engage over corresponding receiving means suitably positioned around said stretcher frame and shaped to allow engagement of said eyelets over said receiving means when said inflatable portion is not inflated and which prevents disengagement of said eyelets from said receiving means when said inflatable portion is inflated; said inflatable portion being positioned between said central portion and said peripheral edge portion and surrounding at least a majority of said central portion, and which, upon inflation secures said support member to said stretcher frame to form a rescue stretcher and imparts buoyancy to said rescue stretcher; said central portion being adapted to receive and retain the patient when said patient is located on said support member.

2. A rescue support member according to claim 1, wherein said inflatable portion is substantially U-shaped and thereby provides a passagway between said central portion and said peripheral edge portion, which passageway is adapted to receive said patient's head and/or neck.

3. A rescue support member according to claim 1, wherein said eyelets are substantially key-hole shaped having a substantially circular opening communicating with a substantially rectangular slot.

4. A rescue support member according to claim 3, wherein said receiving means are headed pins having an enlarged head atop a reduced diameter portion wherein said enlarged pin head is engagable with said circular opening of said eyelet when said inflatable portion is not inflated, and, upon inflation of said inflatable portion, said reduced diameter portion of said pin slidably engages and co-acts with said rectangular slot of said eyelet to secure said support member to said stretcher frame.

5. A rescue support member according to claim 4, further including releasable means for restraining the patient, from excessive sideward, forward or rearward movement during transport of said support member, when positioned upon said central portion of said support member.

6. A rescue support member according to claim 5, wherein said releasable means are a plurality of straps attached to said support member and which are adapted to hold the patient's head, chest and/or leg(s) into contact with said central portion so as to minimize movement of the patient's limbs during transport.

7. A rescue support member according to claim 6, wherein said central portion is further provided with strap tensioning means, through which one end of said strap adapted to hold the patient's leg(s) can pass and co-operate, to minimize movement of one or both of the patient's leg(s) during transport of the patient.

8. A rescue support member according to claim 7, wherein said stretcher frame is a JORDAN stretcher frame.

9. A substantially buoyant rescue support member adapted for use and co-operation with a stretcher frame, for carrying or transporting a patient from a water environment, said support member being air and water impervious and comprising a central portion; an inflatable portion having at least one air inlet port for introducion of air into the interior of the inflatable portion; and a peripheral edge portion having a shape complimentary to the co-operating stretcher frame; said inflatable portion being substantially elongated U-shaped terminating with two opposed rounded ends and being positioned between said central portion and said peripheral edge portion continuously along both longitudinal sides and at least one lateral side of the support member to surround at least a majority of said central portion and thereby provide a passageway between said central portion and said peripheral edge portion at the opposite lateral side of the support member, which passageway is defined by said rounded ends and is adapted to receive a patient's head and/or neck, and which upon inflation secures said support member to said stretcher frame to form a rescue stretcher which will support the weight of an injured patient located on said central portion and which also imparts buoyancy to said support member; said central portion being adapted to receive and retain a patient when said patient is located on said support member yet not retain water which splashes over the inflatable portion; said support member being securable to said stretcher frame by means of substantially key-hole shaped eyelets having a substantially circular opening communicating with a substantially rectangular slot in said peripheral edge portion, said eyelets engaging over corresponding headed pin receiving means suitably positioned around said stretcher frame, said headed pin receiving means having an enlarged head atop a reduced diameter portion wherein said enlarged pin head is engageable with said circular opening of said eyelet when said inflatable portion is not inflated and, upon inflation of said inflatable portion, said reduced diameter portion of said pin slidably engages and co-acts with said rectangular slot of said eyelet to secure said support member to said stretcher frame to form a substantially buoyant rescue stretcher.

10. A rescue support member according to claim 9 wherein said support member is substantially rectangular in shape and comprises two sheets of plastic material block welded together to form a flat central portion, the inflatable portion and the peripheral edge portion of the support member, wherein the inflatable portion, when in the deflated condition, lies in the same plane as the flat central portion.

11. A rescue support member according to claim 10 wherein said stretcher frame is a JORDAN stretcher frame.

12. A rescue support member and a co-operating stretcher frame, for carrying or transporting a patient from a water environment, said support member comprising a central portion; an inflatable portion; and a peripheral edge portion; said peripheral edge portion having eyelets adapted to engage over corresponding receiving means suitably positioned around said stretcher frame and shaped to allow engagement of said eyelets over said receiving means when said inflatable portion is not inflated and which prevents disengagement of said eyelets from said receiving means when said inflatable portion is inflated; said inflatable portion being positioned between said central portion and said peripheral edge portion and surrounding at least a majority of said central portion, and which, upon inflation secures said support member to said stretcher frame to form a rescue stretcher and imparts buoyancy to said rescue stretcher; said central portion being adapted to receive and retain the patient when said patient is located on said support member.

13. A substantially buoyant rescue support member and a co-operating stretcher frame, for carrying or transporting a patient from a water environment, said support member being air and water impervious and comprising a central portion; an inflatable portion having at least one air inlet port for introduction of air into the interior of the inflatable portion; and a peripheral edge portion having a shape complimentary to the co-operating stretcher frame; said inflatable portion being substantially elongated U-shaped terminating with two opposed rounded ends and being positioned between said central portion and said peripheral edge portion continuously along both longitudinal sides and at least one lateral side of the support member to surround at least a majority of said central portion and thereby provide a passageway between said central portion and said peripheral edge portion at the opposite lateral side of the support member, which passageway is defined by said rounded ends and is adapted to receive a patient's head and/or neck, and which upon inflation secures said support member to said stretcher frame to form a rescue stretcher which will support the weight of an injured patient located on said central portion and which also imparts buoyancy to said support member; said central portion being adapted to receive and retain a patient when said patient is located on said support member yet not retain water which splashes over the inflatable portion; said support member being securable to said stretcher frame by means of substantially key-hole shaped eyelets having a substantially circular opening communicating with a substantially rectangular slot in said peripheral edge portion, said eyelets engaging over corresponding headed pin receiving means suitably positioned around said stretcher frame, said headed pin receiving means having an enlarged head atop a reduced diameter portion wherein said enlarged pin head is engageable with said circular opening of said eyelet when said inflatable portion is not inflated and, upon inflation of said inflatable portion, said reduced diameter portion of said pin slidably engages and co-acts with said rectangular slot of said eyelet to secure said support member to said stretcher frame to form a substantially buoyant rescue stretcher.

* * * * *